US005083968A

United States Patent [19]

Hart

[11] Patent Number: 5,083,968

[45] Date of Patent: * Jan. 28, 1992

[54] INTERACTIVE TOY

[76] Inventor: Frank J. Hart, 2811 Mark Ave., Santa Clara, Calif. 95051

[ * ] Notice: The portion of the term of this patent subsequent to Jun. 5, 2007 has been disclaimed.

[21] Appl. No.: 525,698

[22] Filed: May 21, 1990

Related U.S. Application Data

[63] Continuation-in-part of Ser. No. 277,203, Nov. 29, 1988, Pat. No. 4,930,236.

[51] Int. Cl.[5] ..... G08B 19/00

[52] U.S. Cl. ..... 446/431; 901/1; 901/46

[58] Field of Search ..... 446/14, 130, 431, 433, 446/441; 180/167, 169; 901/1, 46

[56] References Cited

U.S. PATENT DOCUMENTS 4,028,533 6/1977 Matsubara ..... 180/169 X
4,565,487 1/1986 Kroczynski ..... 901/1 X
4,636,137 1/1987 Lemelson ..... 901/46 X
4,679,151 7/1987 Perdue ..... 901/1 X
4,772,875 9/1988 Maddox et al. ..... 180/167 X

*Primary Examiner*—Robert A. Hafer
*Assistant Examiner*—Sam Rimel
*Attorney, Agent, or Firm*—Richard C. Litman

[57] ABSTRACT

An interactive toy is capable of detecting and tracking any nearby heat source such as a human body. This device can, in addition to tracking, move to interact with the heat source. The toy can either chase or move away from the heat source according to a set mode of operation. PIR sensors are mounted in a rotating head that is mounted in turn upon a wheeled, tracked or legged body that can move. The device further includes sensors to detect unheated objects in its path and will act to avoid hitting them. The PIR sensors have a limited field of view so as to prevent overlapping fields of view and are filtered or tuned to receive only a certain bandwidth or infrared radiation.

12 Claims, 6 Drawing Sheets

INTERACTIVE TOY

CROSS-REFERENCE TO RELATED APPLICATION

The present application is a continuation-in-part of application Ser. No. 07/277,203, filed Nov. 29, 1988, now U.S. Pat. No. 4,930,236.

BACKGROUND OF THE INVENTION

1. Field of the Invention

The present invention relates to interactive toys. More particularly, the disclosed toy makes use of passive infrared devices and active software to enable the toy to move and react to nearby heat sources (i.e. a human body). The present invention is a further development of the applicant's prior interactive tracking device disclosed in U.S. patent application Ser. No. 07/277,203 in that it utilizes the PIR(passive infrared) sensors the detect and track a heat source. The present invention is now capable of also chasing or moving away from a detected heat source depending on a chosen mode of operation.

2. Description of the Prior Art

Prior art device in the field of moving devices that react to other sensed objects do so in a very limited way. One such prior art device is the security/intrusion detection system disclosed in U.S. Pat. No. 4,772,875 issued to Maddox. This device comprises a mobile body that can travel on wheels. The body has an array of infrared sensors arcuately disposed around the body that can detect heat sources. A rotating turret has a second detector means, in the form of an active infrared or ultrasonic sensor, to verify the intruder's presence and to initialize an alarm sequence. The head or turret must first rotate to the position of the infrared sensor that gave the initial intruder signal and verify the presence of the intruder with the second sensor. This is not a tracking system in that the device can not actually follow the movement of the intruder and react with its own movements. The turret head of Maddox is not capable of small incremental step rotations necessary for tracking. It is only capable of rotating to a specific sensor position. This leads to a very slow reaction time for the Maddox system as a whole due to its inability to execute fine tuned movements.

The field of view of the Maddox device is one in which a plurality of infrared sensors, usually six, continuously receive information in an overlapping 360° field of view. The great number of sensors is necessary due to the fact that the main array cannot move on its own in order to track a target, which is not its intended purpose, it being instead a detection and alarm system.

Numerous infrared sensor systems are known in the field. Some, such as those disclosed in U.S. Pat. Nos. 4,662,854 and 4,828,525 issued to Fang and Okano respectively, disclose active infrared sensors systems. Active infrared sensors emit an infrared signal as well as receive such a signal. A PIR (passive infrared) sensor is capable of only receiving infrared transmissions and radiation. For a tracking device, a PIR receiver would react to only a narrow defined bandwidth of infrared radiation. An active infrared sensor is usually tuned to a bandwidth that will not be confused with other sources of infrared radiation. Many active infrared systems would not want to be confused by human body radiation and so would have a tuned bandwidth that would prevent reaction to human presence. In a device meant to track humans that bandwidth would be about 9.4 micrometers, this being the natural wavelength of heat radiation given off by human beings.

SUMMARY OF THE INVENTION

The present invention comprises a movable body having a rotatable member such as a turret or rotating head atop it. The body can move by means of wheels, treads or moving legs. The continuously rotating turret or head contains a pair or pairs of passive infrared sensors which are used in tracking nearby human heat sources. Each PIR sensor has a limited field of vision so as not to overlap with the other sensor. When a human heat source is detected and tracked, the body can move either toward or away from the heat source depending on the mode chosen.

Accordingly, it is one object of the present invention to provide an interactive device that is capable of tracking a moving human heat source and is capable of physically approaching or moving away from the human heat source.

It is another object of the present invention to provide an interactive toy that utilizes passive infrared sensors to track a human heat source.

It is a further object of the present invention to provide an interactive toy that has a continously rotating head that tracks the human heat source.

It is a yet further object of the present invention to provide an interactive toy that moves upon a wheeled body.

It is a still further object of the present invention to provide an interactive toy that moves upon a tracked body.

It is another object of the present invention to provide an interactive toy that can follow a human heat source and remain at a certain distance away.

It is a further object of the present invention to provide an interactive toy that can detect non-human objects in its way and prevent itself from colliding with them.

These and other objects of the present invention will become readily apparent upon further review of the following specification and drawings.

Figure 1:
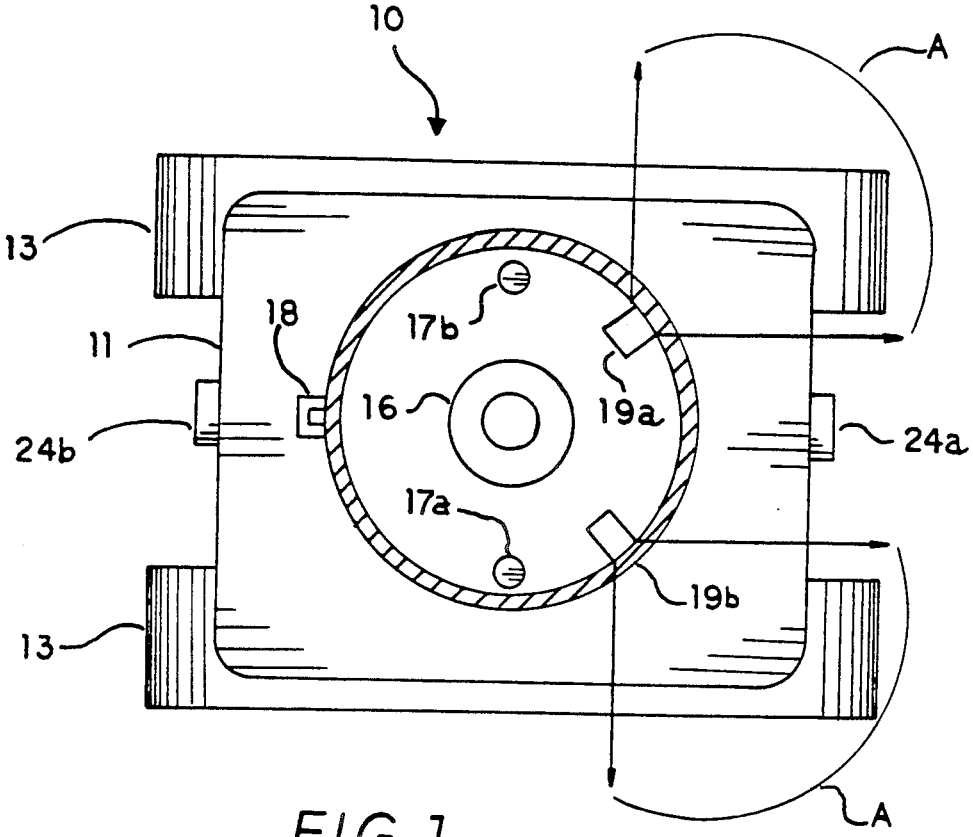
FIG. 1 shows a top cross-sectional view of the tracked embodiment of the interactive toy including the rotating turret or head and the body portion.

FIG. *7a* shows a command flow diagram for the control apparatus used in rotating the turret or head.

FIGS. *7b* and *7c* show command flow diagrams for the control apparatus used in detecting and tracking a heat source.

Similar reference characters denote corresponding features consistently throughout the attached drawings.

A DETAILED DESCRIPTION OF THE PREFERRED EMBODIMENT

Figure 2:
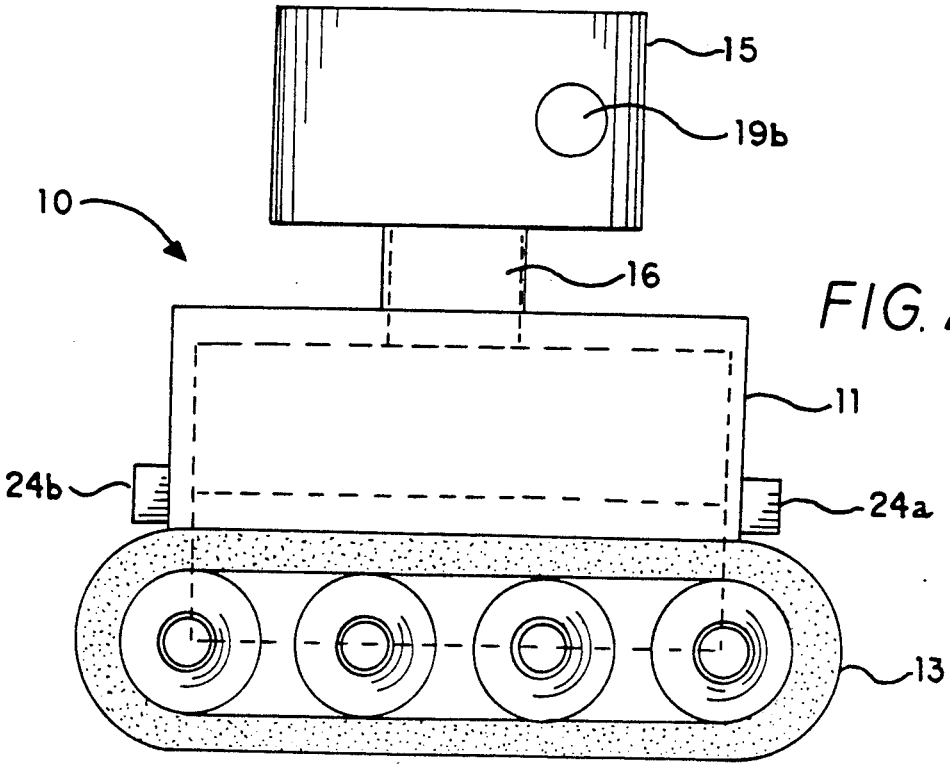
FIG. 2 shows a side view of the tracked embodiment of the interactive toy including the rotating turret or head and the body portion.
Figure 3:
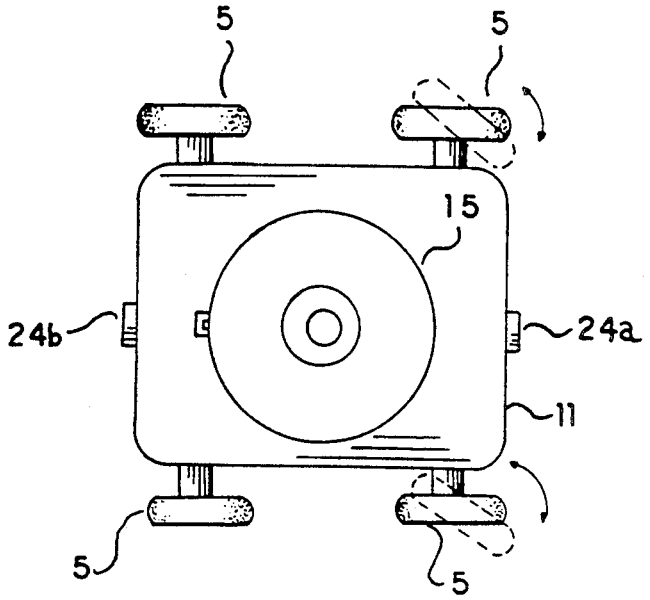
FIG. 3 shows a top cross-sectional view of the wheeled embodiment of the interactive toy including the rotating turret or head and the body portion.

The present invention 10 is shown in FIGS. 1-3 from the exterior, in various embodiments. The external appearance of the present invention 10 may be varied to represent virtually any exterior form. The novel features of the present invention are on the inside; for example, the legged or limbed embodiment might have the appearance of a reptile or other animal. The body 11 of the toy 10 can have wheels 5 or it can have tracks 13 or it can have legs, not shown, to allow the toy to be mobile. An electric motor 14 would operate the wheels 5, tracks 13 or legs upon commands from the control apparatus of the toy 10.

Mounted on top of the body 11 is a rotatable member such as a turret or head 15 that is driven by a stepper motor 16. Stepper motor 16 rotates the turret or head 15 in incremental steps over a 270° arc and then back again over the same arc. The usual increment of rotation is 7.5°, though this of course can be varied. Mounted at the ends of this arc are two stop pins 17*a*, 17*b*, shown in FIG. 3, that serve to mark the end of the rotation of the turret or head 15 in one direction and the beginning of rotation in the opposite direction. A sensor 18 placed adjacent the exterior of the turret or head 15 serves to sense the proximity of one of the stop pins 17*a*, 17*b* as it passes by. This "home" sensor 18 can be magnetic in nature with the stop pins 17*a*, 17*b* being made of a ferrous material so that the magnetic sensor 18 can detect them, or, the sensor can be a light sensor that detects the pin position when the pin interrupts light to the sensor. Once the "home" sensor 18 has detected one of the stop pins 17*a*, 17*b* it will send a signal to the control apparatus to reverse the direction of rotation of the turret or head 15.

Figure 4:
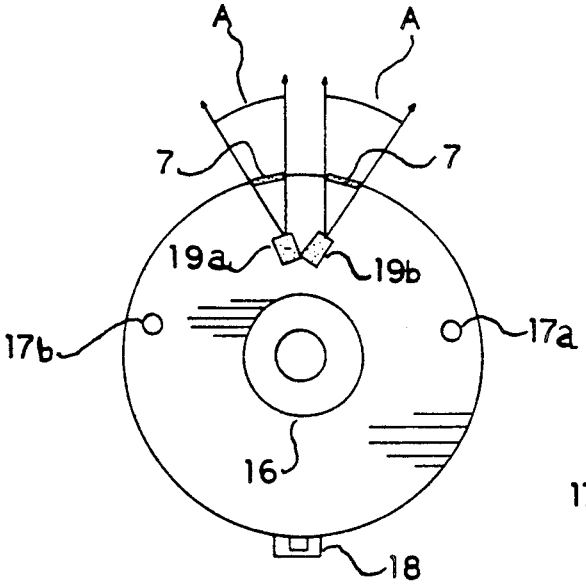
FIGS. 4 and 5 show alternate embodiments of the sensors located in the turret or head.
Figure 5:
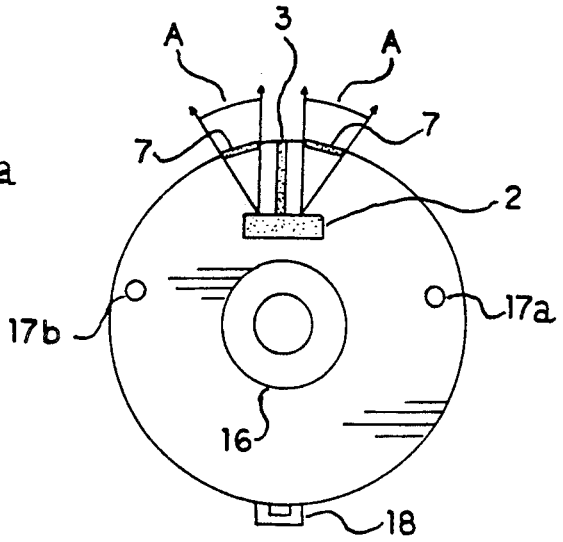

The turret or head 15 rotates in order to provide a scanning mechanism for the PIR (passive infrared) sensors 19*a*, 19*b* mounted with the turret or head 15. There are two of these PIR sensors 19 mounted in a spaced apart relationship in the turret or head 15. Each PIR 19 sensor has a built in field of view Angle A that varies between 60–90 degrees depending on the various manufacturers of the PIR devices. What is important is that the PIR sensors 19*a*, 19*b* are spaced apart enough so that their separate fields of view do not overlap with one another. This Angle A for the field of view can be reduced and narrowed down to 15°-30° by the use of Fresnel lenses 7 placed in front of the PIR sensors 19*a*, 19*b* as shown in FIGS. 4 and 5, or, by covering over part of each PIR sensor 19. Reducing the field of view of each PIR sensor 19 keeps other heat sources out of the field of view. Cutting down on the amount of infrared radiation striking each PIR unit 19 prevents the PIR sensors 19*a* and 19*b* from becoming saturated and non-reactive. A certain amount of recovery time is needed by a PIR unit to recover to a condition where it can detect new infrared radiation. This allows the PIR sensors 19*a* and 19*b* to be sampled by controlling apparatus over a shorter period of time.

FIG. 4 shows the turret or head with an embodiment of the sensors in which each sensor 19 consists of a Fresnel lens 7 in conjunction with a PIR 8. The Fresnel lenses 7 collect radiation and limit the field of view of each sensor.

FIG. 5 shows yet another embodiment of the sensors 19*a*, 19*b* in the turret or head, in which a single PIR package 2 containing two, four or more PIR units is utilized. The PIR or PIRs in the two halves of the package 2 accept radiation separately from the two Fresnel lenses 7. To prevent radiation cross-over, a barrier 3 is interposed between the two Fresnel lenses 7 and between the two PIR unit halves.

Figure 6:
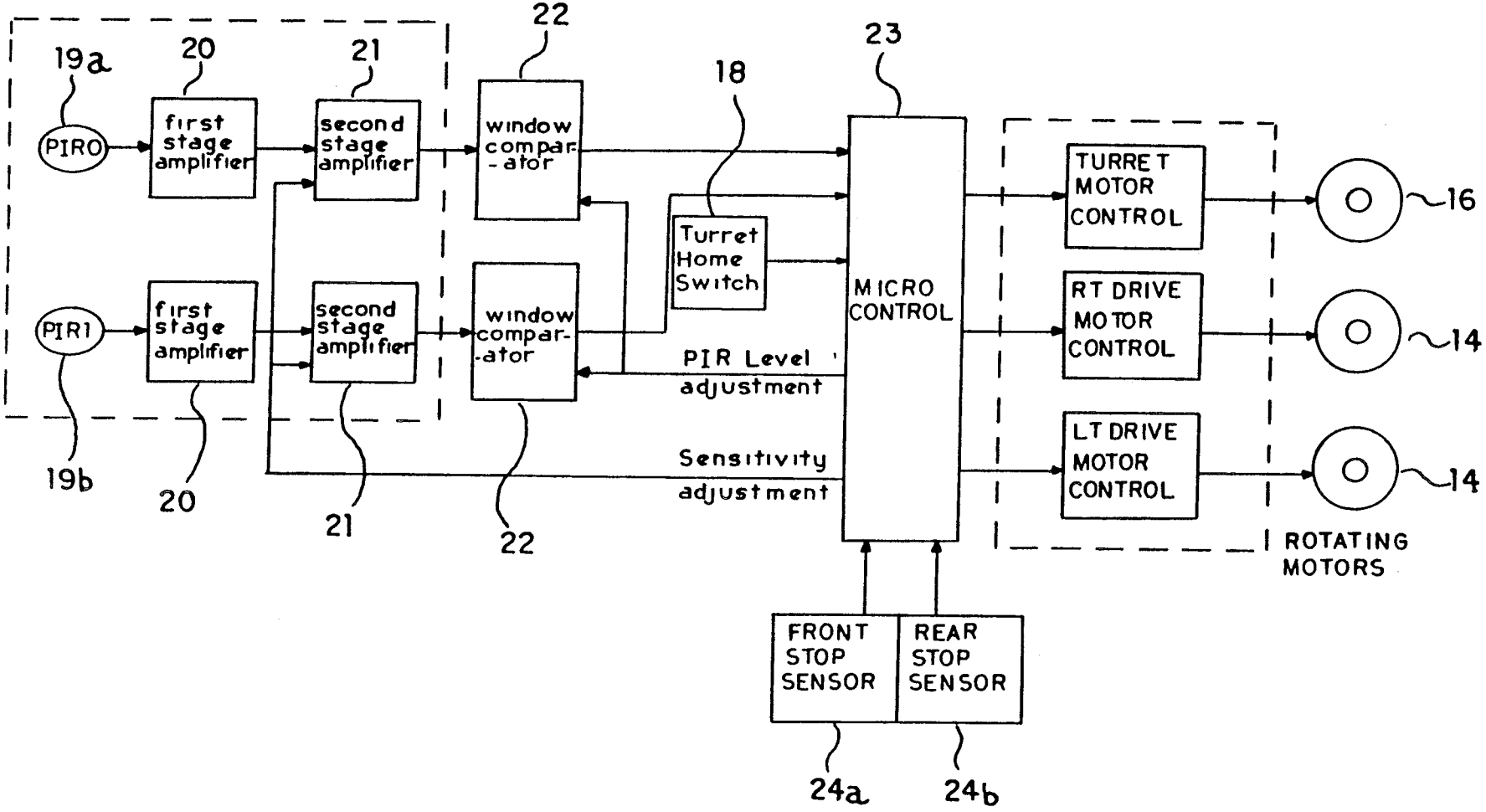
FIG. 6 shows a circuit block diagram of the tracking and controlling apparatus.

FIG. 6 shows a circuit block diagram for the controlling apparatus used with the present invention 10. The circuitry inside the turret or head 15 comprises the already described PIR sensors 19*a*, 19*b*, and first and second stage amplifiers 20, 21 for each PIR sensor 19 to amplify the signal that each PIR sensor transmits. The signal from each second stage amplifier 21 is then sent to a window comparator 22 that compares the incoming signal with a set standard voltage that the incoming signal must overcome to spot any heat sources within the appropriate bandwidth of radiation. For human bodies this would be a band in the range of 9.4 microns. If the incoming signal is strong enough or exceeds the set voltage of comparison, the comparator 22 triggers the micro-control unit 23.

The micro-controller 23 can measure the signal strength and determine if it has approached within a certain distance of the heat source by comparing a set high voltage with the strength of the incoming signal. This is used when the toy is in the tease mode where it will not approach within a certain distance of a target. The controller 23 will notice the increasing signal as the toy 10 approaches closer to the heat source and at a certain level of incoming voltage will cut off any further approaching by the toy 10. The micro-controller 23 can also adjust the sensitivity of the PIR units by varying the amplification of the second stage amplifiers 21. This will allow adjustment of how far away the PIR units 19 will detect a signal and the level of radiation that will trigger the comparator 22. The turret or head "home" switch 18 also will signal the micro-controller 23 to adjust the turret or head 15 rotation. Additionally, the toy 10 has mounted at its front and rear ends stop or proximity sensors 24*a*, 24*b* that can sense when an object is in the way of the toy as it travels. The stop or proximity sensors 24 are active infrared sensors in that they emit and detect a returned signal. These stop or proximity sensors 24 will signal the micro-controller 23 upon detecting a blocking object, at which point the toy 10 will stop its motion.

Figure 7A:
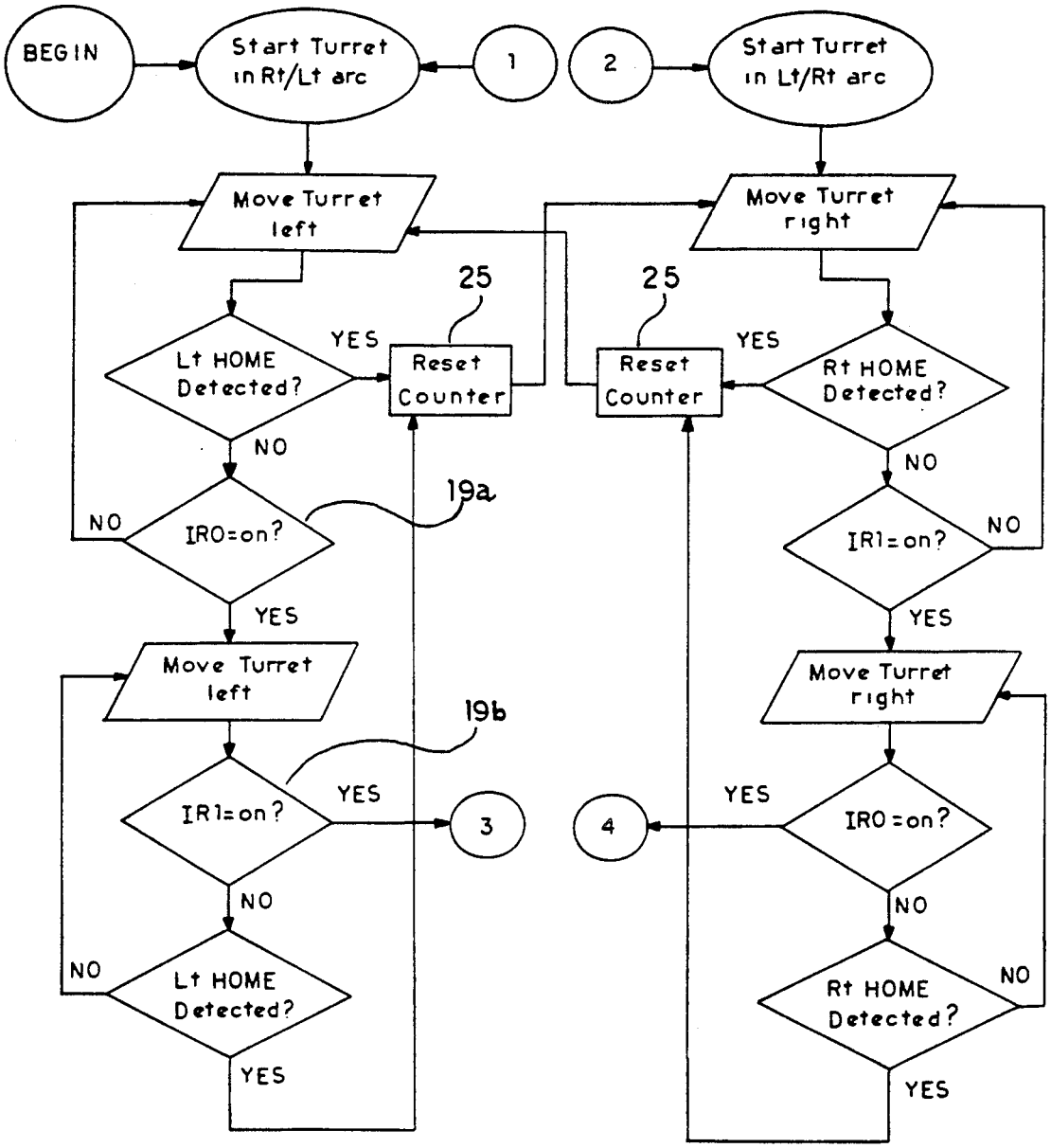
Figure 7B:
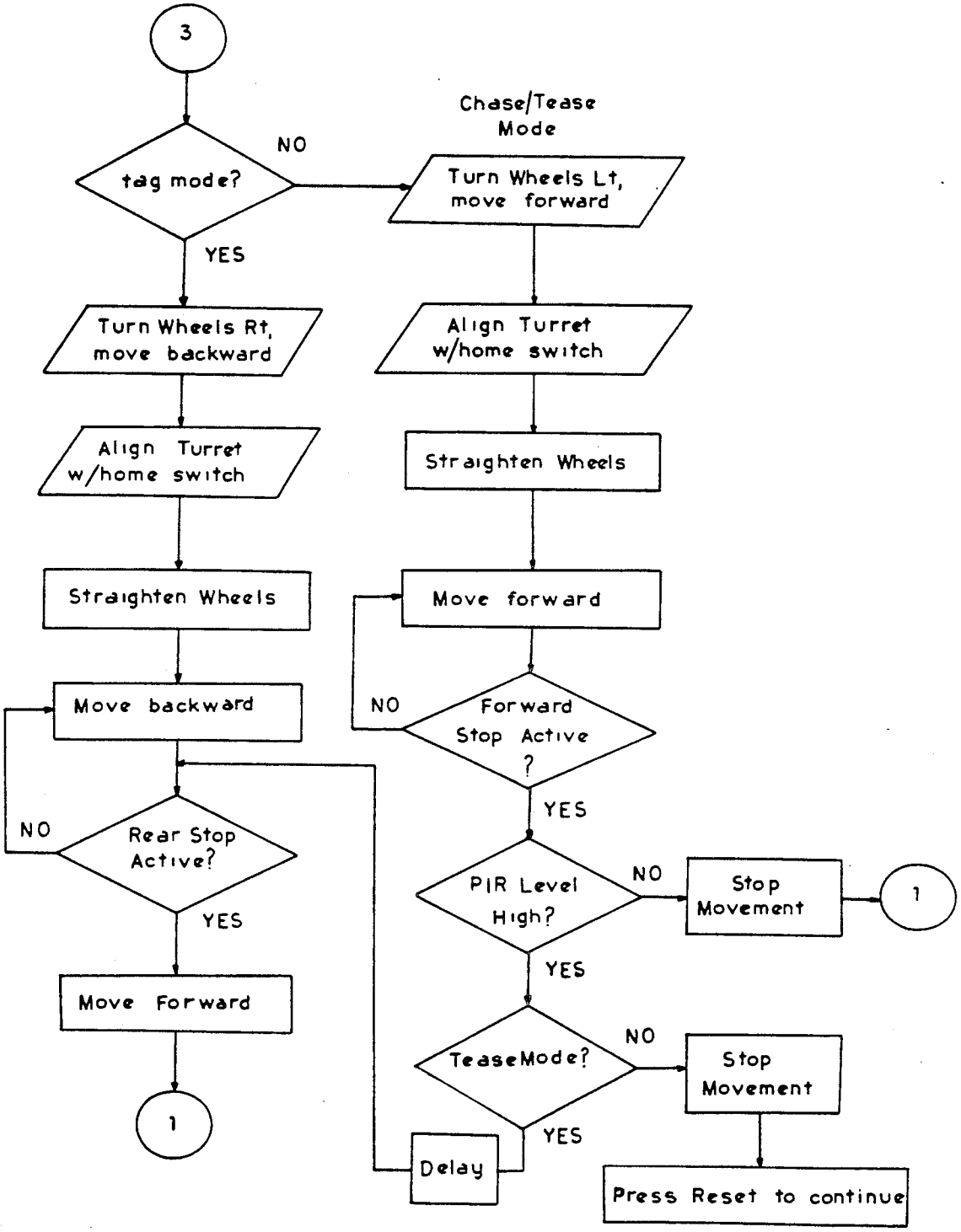

Micro-controller 23 will receive the various inputs from the various sensors and wil act accordingly according to its mode: chase, tease or tag. FIG. 7*a*, is a flow control diagram for turret or head operational control that is exercised by the micro-controller 23. The turret or head 15 starts out with a right to left scan while at the same time it is seeing if either of the PIR sensors 19 are detecting any radiation source. A counter 25 keeps track of the increments as the turret or head is rotated step by step. If none is detected it continues the right to left scan until the "home" switch 18 signal is detected at which point the rotation is reversed to a left to right rotation.

Figure 7C:
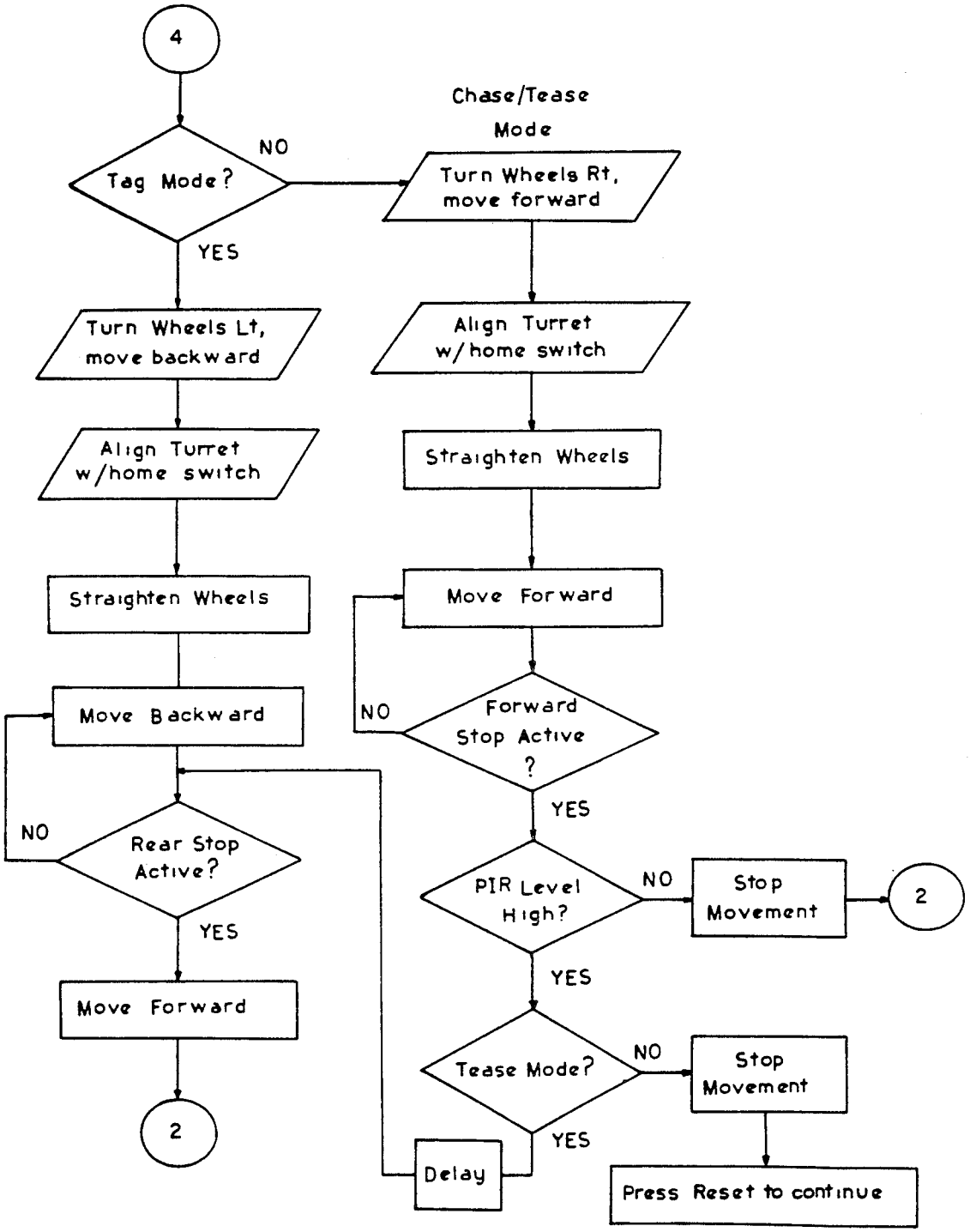

Should a radiation source be detected by the PIR units 19 then the process will jump to a detection mode. The flow of control now switches to FIGS. 7*a* and 7*c*. Tag mode causes the toy to move backwards away from the heat source. It will move backwards until the radiation decreases to a certain level, at which point the toy will stop moving. The chase/tease mode will have the toy moving forward until it comes within a certain distance of the heat source at which point it will stop and wait. If the tease mode is activated, the toy will approach and then back away if the heat source tries to approach closer, such as a person trying to grab the toy. The distance at which the behavior is activated depends upon the High Voltage of the comparator 22.

The three modes of operation (chase, tease, and tag) can be employed, in any combination, in conjunction with the various means of toy locomotion (such as wheels, treads, or legs).

It is believed that a unique interactive toy has been defined by the foregoing specification. The toy allowing for the tracking, chasing or retreating from a detected target.

It is to be understood that the present invetnion is not limited to the sole embodiment described above, but encompasses any and all embodiment within the scope of the following claims.

I claim:

1. An interactive toy capable of detecting, continously tracking and physically interacting with a stationary or mobile heat source, comprising:

a mobile body portion having propulsion means to allow movement of said body portion across a surface;

a rotatable member having stepper motor means mounted to said body portion, said stepper motor capable of continously rotating said rotatable member about a substantially vertical axis in defined increments;

two passive infrared sensors mounted upon said rotatable member to detect a defined bandwidth of radiation, said passive infrared sensors each having an angular field of view and mounted in a horizontally spaced apart relationship with said angular fields of views immediately adjacent;

control means connected in a circuit with said passive infrared sensors to operate said propulsion means upon detection of radiation within said defined bandwidth, whereby;

upon said detection of said heat source by one of said two sensors, said control means causes said stepper motor to rotate said rotatable member to position the other of said two sensors to further detect said heat source, thereby providing for the detection, continual tracking, and interaction of said toy with said heat source.

2. The interactive toy according to claim 1, including:

proximity sensors mounted respectively to a front portion and a rear portion of said body portion to detect any intervening objects in the path of said interactive toy.

3. The interactive toy according to claim 2, wherein:

said proximity sensors comprise active sensors that emit and detect radiation.

4. The interactive toy according to claim 1, wherein:

said propulsion means includes wheels mounted upon said body portion.

5. The interactive toy according to claim 1, wherein:

said propulsion means includes treads mounted upon said body portion.

6. The interactive toy according to claim 1, including:

rotation limit means to define a limit of the rotation of said rotatable member in either direction.

7. The interactive toy according to claim 6, wherein:

said rotation limit means includes two spaced apart stop pins mounted to said rotatable member and a rotation limit sensor to detect said stop pins mounted to said body portion, said rotation limit sensor signaling said control.

8. The interactive toy according to claim 1, wherein:

said control means includes comparator means to compare the incoming signal from said first sensor means with a set standard trigger voltage.

9. The interactive toy according to claim 8, wherein:

said comparator means has a set high voltage to prevent said toy from approaching within a certain distance of said heat source.

10. The interactive toy according to claim 9, wherein:

said standard trigger voltage and said high voltage can be adjusted.

11. The interactive toy according to claim 1, including:

lenses disposed before said passive infrared sensors, whereby said angular field of view of said passive infrared sensors is narrowed.

12. The interactive toy according to claim 1, including;

a barrier positioned between said adjacent passive infrared sensors, whereby overlap of said angular fields of view is prevented and said angular fields of view are narrowed.

* * * * *